US008820558B2

(12) United States Patent
Van der Korput et al.

(10) Patent No.: US 8,820,558 B2
(45) Date of Patent: Sep. 2, 2014

(54) LARGE CONTAINER

(75) Inventors: Maximus Gerardus Maria Van der Korput, Zutphen (NL); Reinhard Lorenz, Uelsen (DE); Peter Johannes Gols, Oldenoltraile (NL)

(73) Assignee: Schoeller Arca Systems GmbH, Schwerin (DE)

( * ) Notice: Subject to any disclaimer, the term of this patent is extended or adjusted under 35 U.S.C. 154(b) by 96 days.

(21) Appl. No.: 13/058,118

(22) PCT Filed: Jul. 10, 2009

(86) PCT No.: PCT/EP2009/005022

§ 371 (c)(1),
(2), (4) Date: Feb. 8, 2011

(87) PCT Pub. No.: WO2010/031456

PCT Pub. Date: Mar. 25, 2010

(65) Prior Publication Data

US 2011/0139674 A1 Jun. 16, 2011

(30) Foreign Application Priority Data

Sep. 18, 2008 (DE) ..... 10 2008 047 857

(51) Int. Cl.

| | |
|---|---|
| ***B65D 6/16*** | (2006.01) |
| ***B65D 19/18*** | (2006.01) |
| ***B65D 19/08*** | (2006.01) |
| *B65D 25/00* | (2006.01) |

(52) U.S. Cl.

CPC ..... *B65D 19/18* (2013.01); *B65D 2519/009* (2013.01); *B65D 25/005* (2013.01); *B65D 2519/00034* (2013.01); *B65D 2519/00791* (2013.01); *B65D 2519/00069* (2013.01); *B65D 2519/00805* (2013.01); *B65D 2519/00875* (2013.01); *B65D 2519/00567* (2013.01); *B65D 2519/00288* (2013.01); *B65D 2519/00273* (2013.01); *B65D 2519/0087* (2013.01); *B65D 19/08* (2013.01); *B65D 2519/00174* (2013.01); *B65D 2519/00502* (2013.01); *B65D 2519/00646* (2013.01)

USPC ..... 220/1.5; 220/4.01; 220/661; 220/660; 220/676; 220/4.28; 206/386; 206/598; 206/600

(58) Field of Classification Search

CPC ..... B65D 25/005; B65D 25/06; B65D 7/40; B65D 7/00; B65D 11/18; B65D 88/127; B65D 90/008

USPC ..... 220/6, 1.5, 7, 254.6, 254.3, 254.1, 660, 220/666, 4.33, 682, 4.28, 4.31, 676; 206/386, 600, 598

See application file for complete search history.

(56) References Cited

U.S. PATENT DOCUMENTS 3,374,915 A * 3/1968 Verhein et al. ..... 220/4.28
3,770,186 A 11/1973 Kupersmit (Continued)

FOREIGN PATENT DOCUMENTS

CH 479452 10/1969
CH 700586 12/1978

(Continued)

*Primary Examiner* — Mickey Yu
*Assistant Examiner* — Gideon Weinerth
(74) *Attorney, Agent, or Firm* — Price Heneveld LLP

(57) ABSTRACT

A large container (2) comprises a bottom part (3) and four side walls (4, 8), of which at least one is fastened with at least one hinge to the bottom part (3) and, by these means, can be folded down to the bottom part (3). At least one of the side walls (4, 8) has a movable side part (10), which is constructed so that by moving the movable side part (10), the corresponding side wall (8) can be opened partially.

11 Claims, 5 Drawing Sheets

(56) References Cited

U.S. PATENT DOCUMENTS

| | | | | | |
|---|---|---|---|---|---|
| 3,812,999 | A * | 5/1974 | Joseph | 220/494 |
| 3,841,519 | A * | 10/1974 | Stromberg | 206/427 |
| 3,966,285 | A * | 6/1976 | Porch et al. | 312/265.4 |
| 4,015,714 | A | 4/1977 | Silver et al. | |
| RE29,262 | E * | 6/1977 | Utz | 220/516 |
| 4,221,302 | A * | 9/1980 | Kupersmit | 220/4.31 |
| 4,693,386 | A * | 9/1987 | Hughes et al. | 220/1.5 |
| 4,726,485 | A * | 2/1988 | Bailey | 220/6 |
| 4,809,851 | A * | 3/1989 | Oestreich et al. | 206/599 |
| 4,917,255 | A | 4/1990 | Foy et al. | |
| 4,923,079 | A * | 5/1990 | Foy | 220/7 |
| 5,161,709 | A * | 11/1992 | Oestreich, Jr. | 220/6 |
| 5,285,900 | A | 2/1994 | Swingler | |
| 5,474,197 | A * | 12/1995 | Hillis et al. | 220/6 |
| 5,558,241 | A * | 9/1996 | Huffstutler et al. | 220/1.5 |
| 5,829,617 | A | 11/1998 | Umiker | |
| 5,924,572 | A * | 7/1999 | Cope | 206/518 |
| 6,085,932 | A * | 7/2000 | Cope | 220/529 |
| 6,170,689 | B1 * | 1/2001 | Flesher et al. | 220/7 |
| 6,290,081 | B1 * | 9/2001 | Merey | 220/7 |
| 6,776,300 | B2 * | 8/2004 | Walsh et al. | 220/6 |
| 7,441,671 | B2 * | 10/2008 | McPhee | 220/1.5 |
| 7,556,166 | B2 * | 7/2009 | Parnall et al. | 220/6 |
| 8,066,147 | B2 * | 11/2011 | Meers et al. | 220/682 |
| 8,272,410 | B2 * | 9/2012 | Elgan et al. | 141/10 |
| 8,511,496 | B2 * | 8/2013 | Van Der Korput et al. | 220/6 |
| 8,561,836 | B2 * | 10/2013 | Cook | 220/812 |
| 8,646,639 | B2 * | 2/2014 | Pils et al. | 220/7 |
| 2004/0200833 | A1 * | 10/2004 | Dubois et al. | 220/6 |
| 2004/0261889 | A1 | 12/2004 | Elgan et al. | |
| 2005/0121448 | A1 * | 6/2005 | Rader | 220/6 |
| 2005/0199623 | A1 * | 9/2005 | Elder et al. | 220/4.28 |
| 2008/0017649 | A1 * | 1/2008 | Elgan et al. | 220/495.06 |
| 2008/0296308 | A1 * | 12/2008 | Barbalho et al. | 220/666 |
| 2009/0212049 | A1 * | 8/2009 | Anhel | 220/4.28 |
| 2012/0152799 | A1 * | 6/2012 | Ficker | 206/600 |
| 2013/0057135 | A1 * | 3/2013 | Bradford et al. | 312/321 |

FOREIGN PATENT DOCUMENTS

| | | | | |
|---|---|---|---|---|
| CH | 691056 | A5 | 4/2001 | |
| CH | 700586 | B1 * | 9/2010 | B65D 19/18 |
| DE | 9014480 | | 10/1990 | |
| DE | 69826757 | | 2/2006 | |
| DE | 202005009037 | | 8/2006 | |
| EP | 0835816 | | 4/1998 | |
| GB | 2311276 | A | 9/1997 | |
| GB | 2377695 | A | 1/2003 | |
| WO | 2004087320 | | 10/2004 | |

* cited by examiner

LARGE CONTAINER

FIELD OF THE INVENTION

The invention relates to a large container with a base component and four side walls wherein at least one of the four side walls is attached at the base component through at least one hinge, so that the side wall is foldable towards the base component.

BACKGROUND OF THE INVENTION

Large containers of this type which are designated as large cargo carriers typically have dimensions of 800×600 mm, 1200×800 mm, 1200×1000 mm, or 1200×1600 mm, which are standard sizes. The height of large cargo carriers of this type depends on the desired receiving capacity. A typical height above the contact surface of the large cargo carrier up to the upper edge of the side wall is 1000 mm. This defines the large container over other smaller containers, like e.g. fruit and vegetable containers or bottle crates and containers which can be stacked on pallets in multiple layers on top of one another and adjacent to one another. The large containers or large cargo carriers are used for receiving, in particular, bulk materials and are often used for transporting large volume products in the food industry, the non-food field, the industrial field and the auto industry. Large containers of this type are voluminous and have a greater material thickness as compared to the typical fruit and vegetable containers. Containers of this type are also thicker and heavier over all, so that transporting filled large containers can typically only be performed mechanically, in particular, by forklifts or machines.

In order to reduce the return shipment volume of such large containers typically used as reusable containers, the side walls are either foldable overall, only partially foldable, or foldable one by one, wherein the side walls can be locked together in a transport position. Locking devices of this type for containers of this type are known. Typically, locking devices of this type include engagement lugs that are configured at a side wall and engage a recess of an adjacent side wall or engage behind a locking bar of the adjacent side wall in a locking position, thus facilitating the locked transport position.

A container is known from DE 698 26 757 T2 which includes four circumferentially disposed side walls on a base, wherein the side walls are pivotably linked to the base and thus can be folded onto the base in order to reduce the transport volume when being shipped empty. In order to retrieve transported material when the side walls of the container are standing upright, a flap is provided in at least one side wall, wherein the flap is pivotably linked through a hinge with a lower side wall component and can be folded from the outside over the lower side wall component. In a folded position, in order to ensure that the side wall components folded on top of one another are essentially flush with the other side wall sections, the flap and also the side wall component disposed thereunder have wave profiles on their outsides which reach over one another in folded positions so that the folded down flap together with the lower side wall component onto which the flap is folded down has a thickness which is not thicker than the respective side wall. However, a flap mechanism for large containers is complex and, in particular, can be detrimental because the typical flap, which has to be pivoted outward and then downward, is more difficult to handle in view of the size of the side wall. The flap can be particularly detrimental in tight storage situations, since the flap has considerable weight in view of the size of the side wall. This can cause a problem for bulk material within the large container due to the substantial weight of the flap folding downward quickly against the efforts of the operator, so that loose bulk material can unintentionally fall out and become damaged.

SUMMARY OF THE INVENTION

Thus, it is an object of the invention to provide a large container with circumferential side walls which are foldable inward onto the base of the container in which at least one side wall can be opened in a simple and safe manner for retrieving transported material.

An aspect of the present invention is to provide a moveable side component that is provided in at least one of the side walls of the large container, wherein the side component is moveable in a linear manner relative to the side wall from an upper closed position into a lower open position through a non-moveable side component disposed below the moveable side wall wherein the non-moveable side component is preferably fixed to the side wall. The moveable side component provides a partial opening of the side wall of the container. Operating the moveable side component can be performed from the top in a downward direction based on the translational displacement of the moving component, which can be performed progressively, and thus without a risk of materials falling out of the container. In an open position, the moveable side component covers the non-moveable side component which is fixed at the side wall. Thus, the combined thickness of the moveable and non-moveable side components is advantageously configured so that when the moveable side component is moved in front of the non-moveable side component, the moveable and non-moveable side components remain flush with the inside surface (referred to in the figures as reference 28) and outside surface (referred to in the figures as reference 30) of the rest of the at least one side wall when the moveable side component is in an open position. The linear movability of the moveable side component yields simple handling which facilitates opening in very tight spaces since no side wall section is moved outward during opening.

Advantageously, the moveable side component can be moved into an overlap position outside of the lower side component, so that moving down or pressing down the moveable side component cannot be blocked by goods disposed within the container. The moveable side component can be lockable relative to the at least one side wall in a non-opened position of the side component through two laterally disposed locking devices. For this purpose, typical locking mechanisms are suitable. In particular a locking lug that is actuatable through a handle element of the locking device, wherein the locking lug is pressed inward in a direction towards the center of the moveable side component and thus is moved out of a locking recess of the adjacent side wall section of the at least one side wall, so that the moveable side component can then be moved downward. In this context, the handle element can be configured as an elastic bar, so that opening the locking device builds up a resilient reset force which presses the locking lug back into its starting position after the locking device is disengaged. This facilitates simple locking. Alternatively, the locking lug can also be resiliently pre-loaded, so that it has to be pressed out of its locking position against a spring effect and then snaps back into its closed position after releasing or letting go of the handle element of the locking device.

Several locking recesses can be disposed in the adjacent side wall section of the at least one side wall with even distances, so that the moveable side component can be adjusted downward, thus an adjustable opening of the moveable side component is facilitated, wherein the locking lug can then engage an intermediary position in one of the locking recesses, so that an opening is also facilitated in intermediary positions.

In order to provide linear movability, the moveable side component includes a longitudinal key on both sides which engages a respective longitudinal groove in the adjacent side wall section of the at least one side wall, so that a translational support is provided on both sides. This facilitates moving the moveable side component in upward and downward direction without wedging. Different support elements can certainly also be provided.

BRIEF DESCRIPTION OF THE DRAWINGS

Embodiments of the invention are subsequently described with reference to schematic drawing figures, wherein.

Elements with a like structure or function are designated with like numerals in all figures.

DETAILED DESCRIPTION OF PREFERRED EMBODIMENT

Figure 1:
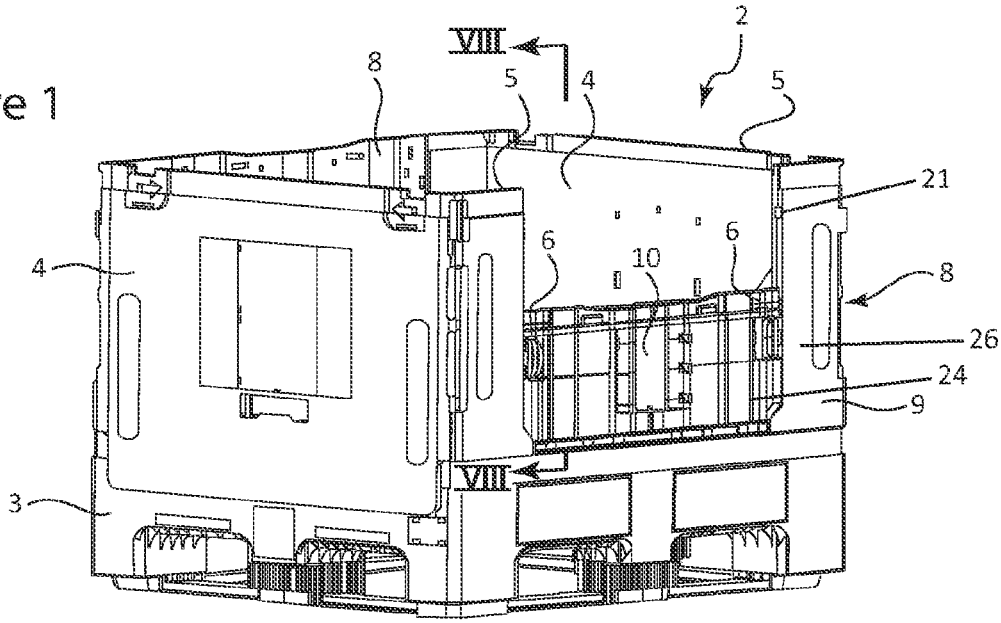
FIG. 1 illustrates a large container with a moveable side component in an open condition.

FIG. 1 illustrates a large container 2 with four side walls 4, 8. The side walls 4, 8 are attached at the base component 3 through hinges, so that the side walls 4, 8 can be folded down towards a center of the large container 2. The complete foldability is facilitated through different heights of the base component 3 proximate the hinges. At least one (e.g., two) of the side walls 8 includes a moveable side component 10 in order to facilitate access to the interior of the container. Each moveable side component 10 includes at least one locking device 6 (e.g., two locking devices 6) that closes the moveable side component 10 in its upper closed condition according to FIG. 2. An opening (e.g., centrally disposed) of the large container 2 is shown in FIG. 1. As evident from FIG. 1, the opening is laterally defined by wall sections 9 on both sides of the opening. When necessary, the locking devices 6 can also be disposed at the wall sections 9 outside of the moveable side component 10.

Figure 2:
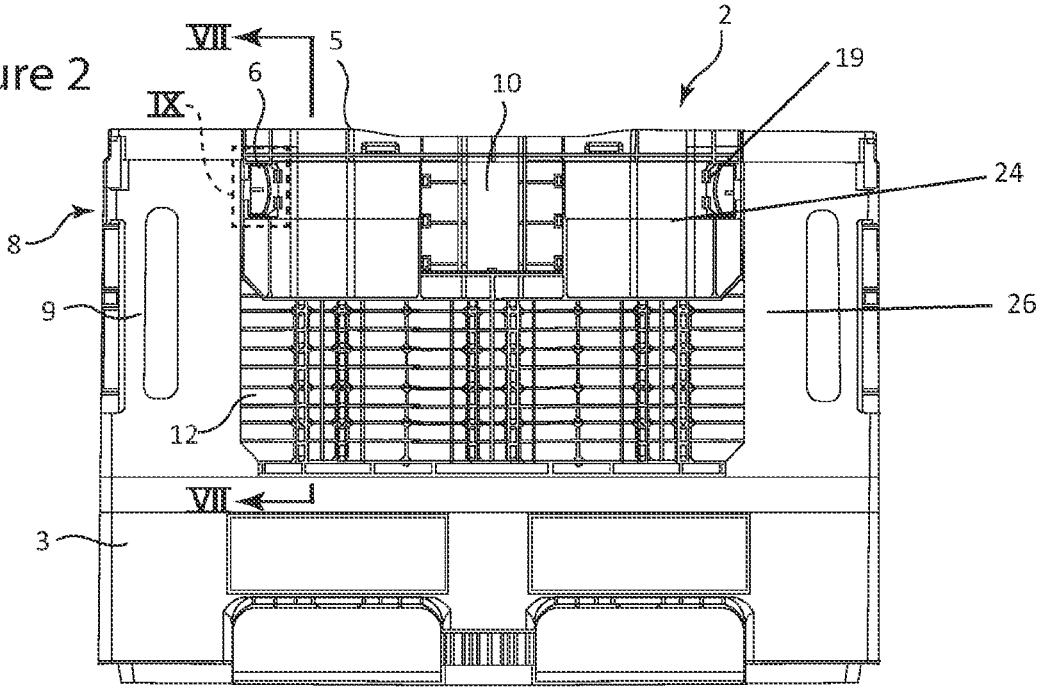
FIG. 2 illustrates a large container in a side view with a moveable side component in a closed condition.
Figure 3:
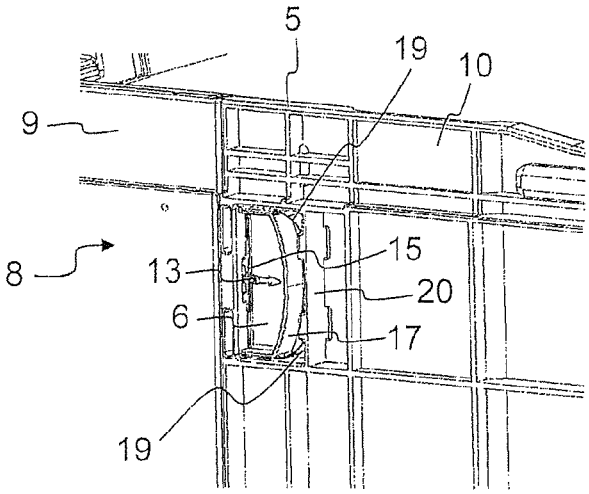
FIG. 3 illustrates a detailed view of the large container with a moveable side component in a closed condition.

FIG. 2 illustrates the large container 2 according to FIG. 1 with the moveable side component 10 in a closed condition. A non-moveable side component 12 of the large container 2 is disposed thereunder, wherein the non-moveable side component 12 is at least partially or completely covered by the moveable side component 10 in an open condition of the moveable side component 10.

Figure 4:
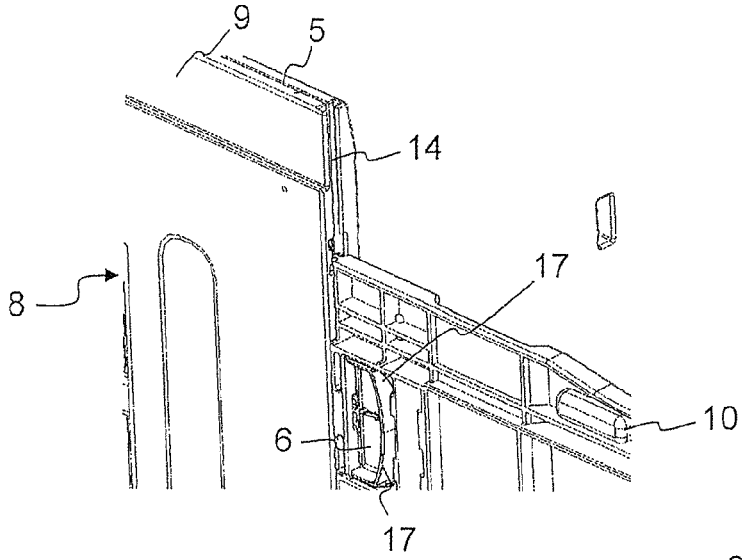
FIG. 4 illustrates the detail view of the large container with the movable side piece in a partially open condition.
Figure 5:
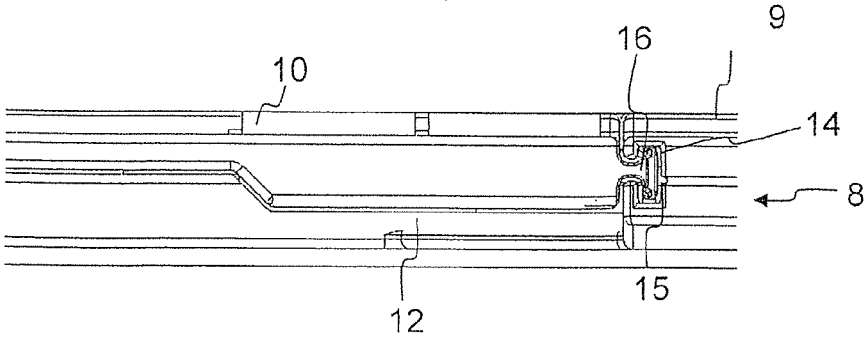
FIG. 5 illustrates a top plan detail view of the embodiment of FIG. 4.
Figure 6:
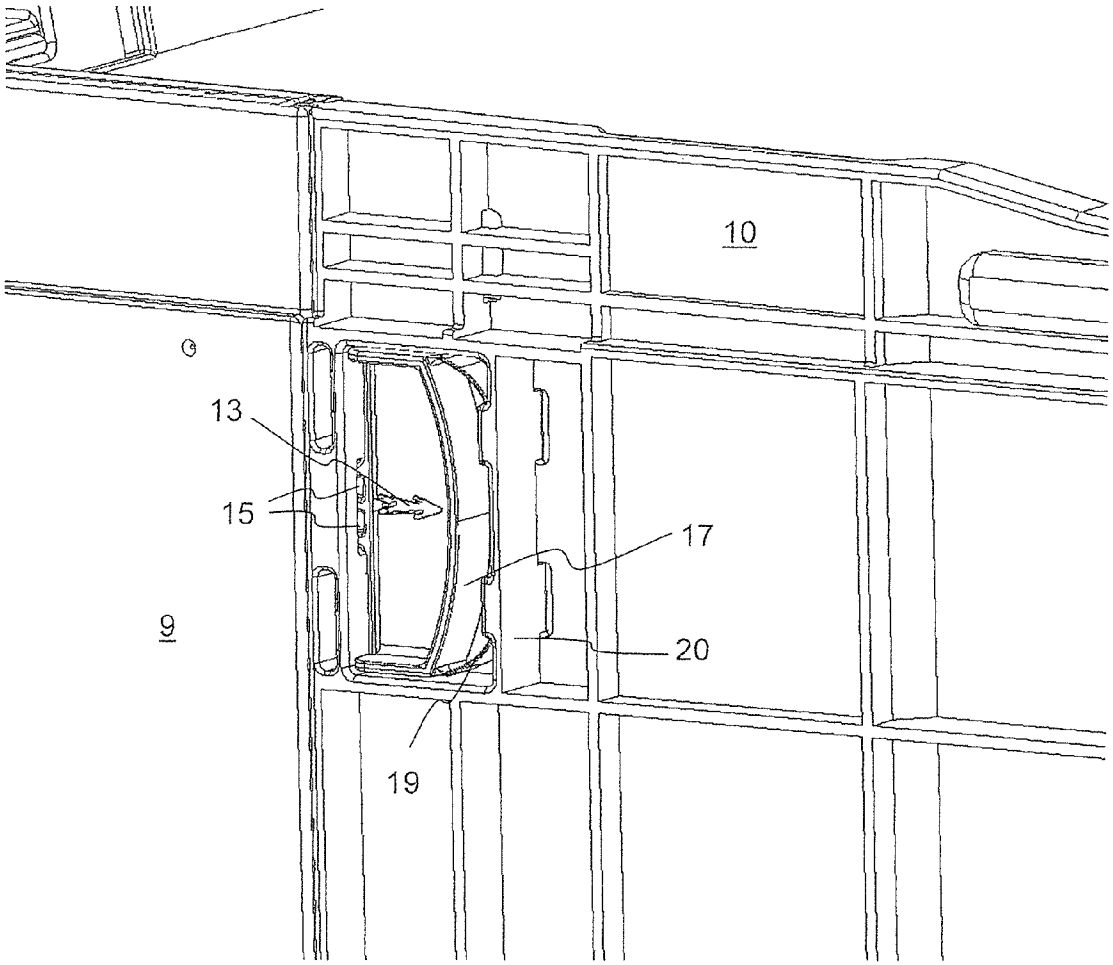
FIG. 6 illustrates a detail view analogous to FIG. 3 for illustrating the handle element.
Figure 7:
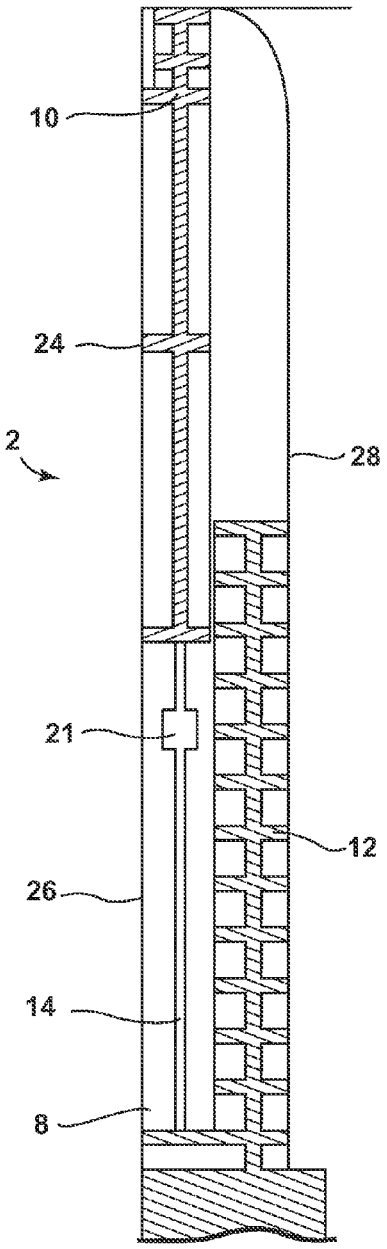
FIG. 7 illustrates a cross-sectional view of the large container of FIG. 2, taken at line VII-VII.
Figure 8:
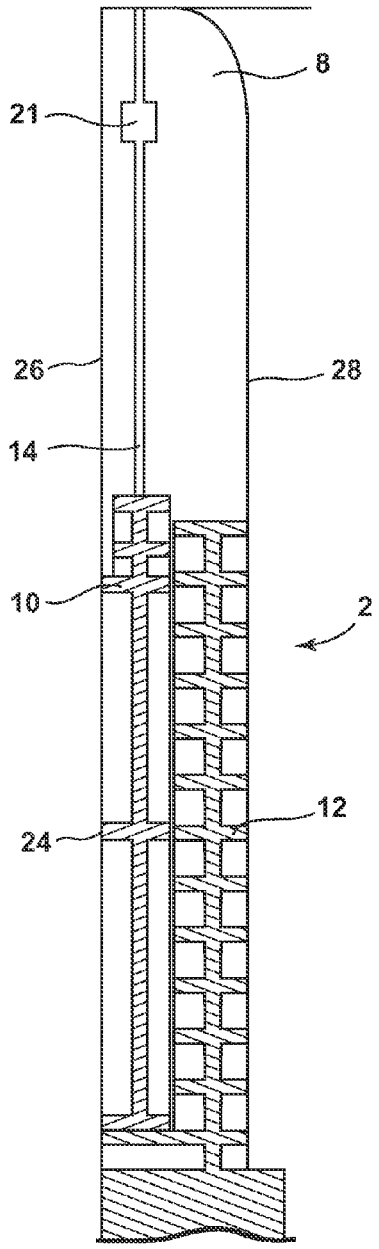
FIG. 8 illustrates a cross-sectional view of the large container of FIG. 1, taken at line VIII-VIII.
Figure 9:
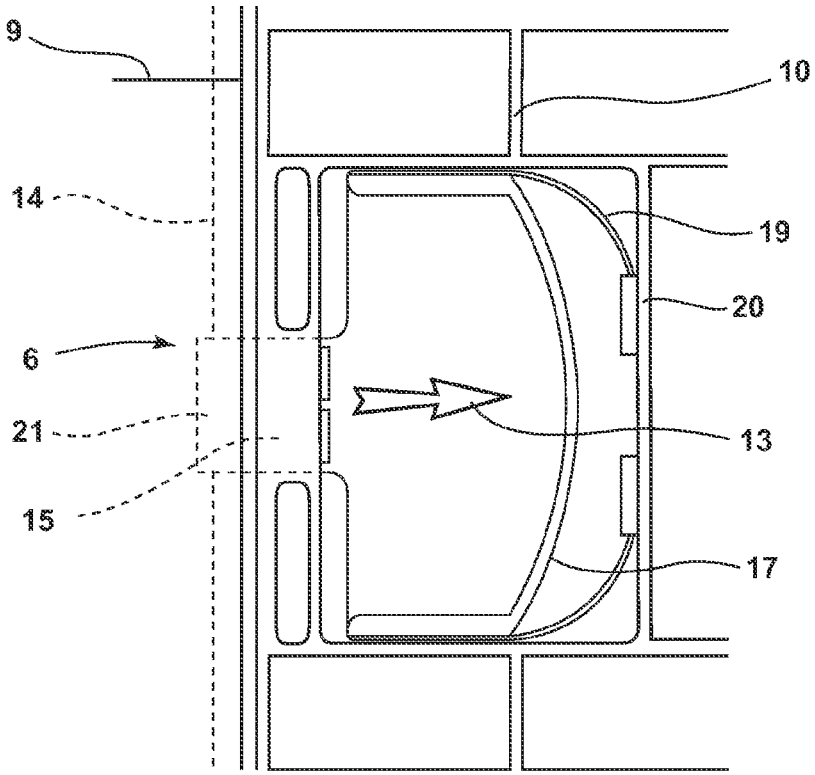
FIG. 9 illustrates a detail elevational view of the large container of FIG. 2, taken at area IX with the locking lug in the locking recess.
Figure 10:
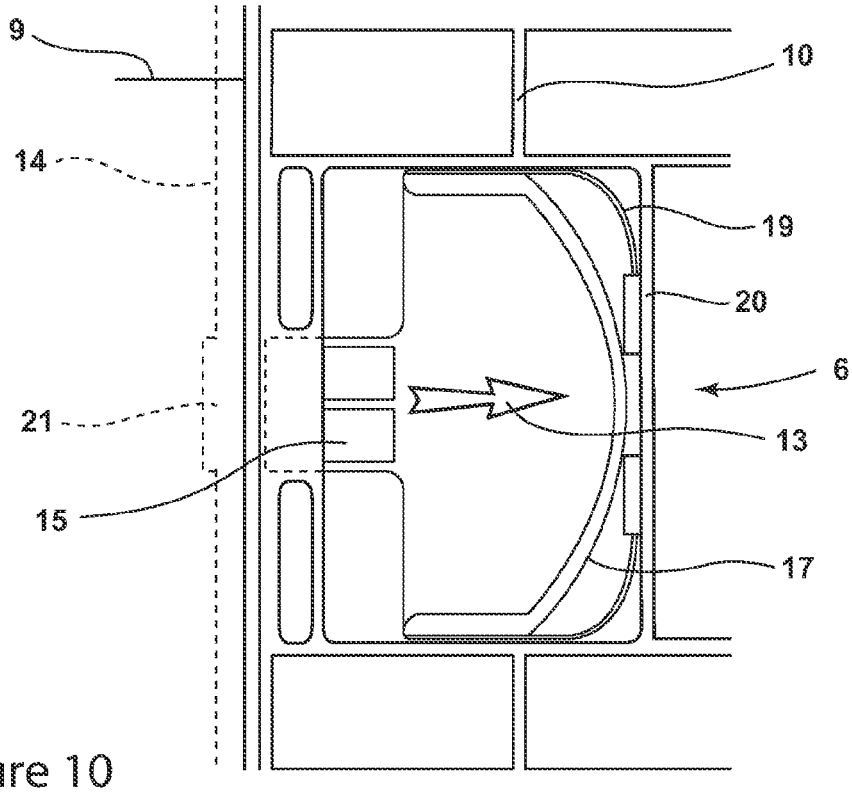
FIG. 10 illustrates the detail elevational view of the large container of FIG. 9, with the locking lug removed from the locking recess.

FIGS. 3 and 6-10 illustrate a detail view of the large container 2 with the moveable side component 10 in a closed condition. The locking device 6 can include a recess 13 which is engaged by respective lug-shaped protrusions 7 of the moveable side component 10. The recess 13 and the lug-shaped protrusion 7 facilitate supporting a handle element of the locking device 6 and/or form a stop for the handle element. In the most simple form, the handle element is coupled with the locking lug 15 which engages a respective locking recess 21 of the wall section 9 outside of the moveable side component 10 (or vice versa) in a closed and locked condition of the locking device 6. Locked connections of the type are known, so that they do not have to be illustrated in detail. The locking lug is designated with 15 (FIGS. 4 and 5). For unlocking, the handle element is then pressed in the direction of the center of the moveable side component 10, which pulls the locking lug 15 out of the locking recess 21 in the wall section 9. For this purpose, the handle element can be provided with a handle bar 17. Slightly cambered tongues 19 are integrally provided at the handle element on both sides of the handle bar 17, wherein the slightly cambered tongues 19 contact a vertical bar 20 of the moving component 10. When the handle element is moved to the center, the slightly cambered tongues 19 are preloaded and press the handle element back, against the vertical bar 20, in an outward direction again into the locking position after the handle element is removed. In the unlocked condition, the moveable side component 10 can then be pressed downward into its open position. The locking device 6, in particular, its bar-shaped handle element, can be operated in a particularly intuitive manner when the recess 13 is arrow shaped. Thus, the arrow top can point into an opening direction of the locking device 6.

FIG. 4 illustrates a detail view of the large container 2 with the moveable side component 10 in an at least partially open condition. Thus, a longitudinal groove 14 is visible in the wall section 9 outside of the moveable side component 10.

As is apparent from FIG. 5, which illustrates a top plan view of the detail according to FIG. 4, a longitudinal key 16 of the moveable side component 10 engages the longitudinal groove 14. The longitudinal key 16 can be configured as dove tailed. The longitudinal groove 14 and the longitudinal key 16 facilitate supporting the moveable side component 10 in the wall section 9 outside of the moveable side component 10 without wedging. The longitudinal groove 14 is provided in the two lateral wall sections 9 of the at least one side wall 8.

In the illustrated embodiment as shown in FIGS. 1-10, the moveable side component 10 and the non-moveable side component 12 are configured and arranged so that the moveable side component 10 is moved outward by the thickness of the lower non-moveable side component 12, so that the moveable side component 10 can be moved downward into the open position in front of the non-moveable side component 12. Thus, the moveable side component 10 overlaps the non-moveable side component 12 in an open position. In a closed position, the outer surface 24 of the moving component 10 remains flush with the outer surface 26 of the side wall 8.

The large container 2 can include additional side walls 8 with moveable side components 10. The large container 2 can also include additional, or fewer, side walls 4 that do not include a moveable side component 10.

The invention claimed is:

1. A large collapsible container comprising:

a base component provided with engagement openings for fork lift transportation; and four side walls, each with a first thickness, and connected with the base component, wherein at least one of the side walls includes an opening feature;

wherein the opening feature comprises:

a vertically sliding door having a second thickness;

a stationary wall having a third thickness; and at least one locking device for fixing the sliding door in a predetermined vertical position;

wherein the locking device includes a handle element having a locking lug which engages a corresponding locking recess defined within the one of the sidewalls;

wherein the vertically sliding door may be moved from an open position to a closed position;

wherein in the open position, the vertically sliding door is in front of the stationary wall; and wherein the combined thickness of the vertically sliding door and the stationary wall is equal to the first thickness of the sidewall, and wherein an outer extent of the sidewall with the opening feature and an outer extent of the vertically sliding door present a flat surface in either the open or closed position.

2. The large collapsible container according to claim 1, wherein the vertically sliding door is offset towards the outer extent of the sidewall with the opening feature a distance substantially equivalent to the thickness of the stationary wall.

3. The large collapsible container according to claim 1, wherein the vertically sliding door includes two locking devices for fixing the vertically sliding door in at least one of the open position, the closed position and an intermediate position between the open and closed positions.

4. The large collapsible container according to claim 3, wherein the handle of each of the locking devices includes a recess, into which a protrusion of the vertically sliding door engages for supporting the handle element.

5. The large collapsible container according to claim 4, wherein the recess has an arrow shape and an arrow head of the arrow shape points in an opening direction of the locking device.

6. The large collapsible container according to claim 1, wherein the vertically sliding door comprises first and second longitudinal tabs at horizontal side edges of the vertically sliding door, wherein the first and second longitudinal tabs engage respective first and second longitudinal grooves of the side walls with the opening feature for supporting the moveable side component at the sidewall with the opening feature.

7. The large collapsible container according to claim 6, wherein the longitudinal tab includes a dove tail profile.

8. The large collapsible container according to claim 6, wherein the sidewall with the opening feature includes two sidewall sections disposed adjacent to the vertically sliding door, and wherein each of the two sidewall sections includes a locking device for fixing the vertically sliding door in at least one of the open position, the closed position and an intermediate position between the open and closed positions.

9. The large collapsible container according to claim 8, wherein the handle of each locking device includes a recess into which a protrusion of the at least one of the sidewalls engages for supporting the handle element.

10. The large collapsible container according to claim 8, wherein an inner extent of the stationary wall is flush with an inner extent of the two sidewall sections.

11. The large collapsible container according to claim 8, wherein the longitudinal groove is a linear channel that is configured to receive the longitudinal tab, the longitudinal tab being an extruded element slidably engaged with the longitudinal groove, and wherein the locking recess of the locking device is at least partially defined within the longitudinal groove and the longitudinal tab, and wherein the longitudinal groove defines a plurality of locking recesses configured to receive the locking lug, the plurality of locking recesses defining at least the open and closed positions of the vertically sliding door relative to the sidewall section.

* * * * *